US011421294B2

(12) United States Patent
Han et al.

(10) Patent No.: US 11,421,294 B2
(45) Date of Patent: Aug. 23, 2022

(54) HIGH STRENGTH STEEL SHEET HAVING EXCELLENT FORMABILITY AND MANUFACTURING METHOD THEREOF

(71) Applicant: POSCO, Pohang-si (KR)

(72) Inventors: Sang-Ho Han, Gwangyang-si (KR); Je-Woong Lee, Gwangyang-si (KR)

(73) Assignee: POSCO, Pohang-si (KR)

( * ) Notice: Subject to any disclaimer, the term of this patent is extended or adjusted under 35 U.S.C. 154(b) by 309 days.

(21) Appl. No.: 16/324,290

(22) PCT Filed: Aug. 4, 2017

(86) PCT No.: PCT/KR2017/008435
§ 371 (c)(1),
(2) Date: Feb. 8, 2019

(87) PCT Pub. No.: WO2018/030715
PCT Pub. Date: Feb. 15, 2018

(65) Prior Publication Data

US 2020/0399729 A1 Dec. 24, 2020

(30) Foreign Application Priority Data

Aug. 12, 2016 (KR) ..... 10-2016-0102946

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/005* (2013.01); *C21D 6/008* (2013.01); *C21D 8/0205* (2013.01);
(Continued)

(58) Field of Classification Search
CPC ..... C21D 6/005; C21D 6/008; C21D 9/46; C21D 8/0205; C21D 8/0226;
(Continued)

(56) References Cited

U.S. PATENT DOCUMENTS

2015/0252456 A1* 9/2015 Kizu ..... C21D 8/0236 148/603

FOREIGN PATENT DOCUMENTS

EP 0572666 2/1992
IN 2735MUM2011 3/2013
(Continued)

OTHER PUBLICATIONS

JP-2004099951-A, Fujimoto Nobukazu; Fujiwara Susumu; Higo Yuichi, English Translation, 2004 (Year: 2004).*
(Continued)

*Primary Examiner* — Anthony J Zimmer
*Assistant Examiner* — Jacob J Gusewelle
(74) *Attorney, Agent, or Firm* — Cantor Colburn LLP

(57) ABSTRACT

A high strength steel sheet including, by weight, C: 0.001% to 0.004%, Si: 0.5% or less (excluding 0%), Mn: 1.2% or less (excluding 0%), P: 0.005% to 0.12%, S: 0.01% or less, N: 0.01% or less, acid soluble Al: 0.1% or less (excluding 0%), Ti: 0.01% to 0.04%, a remainder of Fe, and unavoidable impurities, wherein the contents of Ti, N, and S satisfy the following Relationship 1, a ratio (b/a) of an average random intensity ratio (b) of an orientation group of (111) [1-10] to (111) [−1-12] to an average random intensity ratio (a) of an orientation group of (001) [1-10] to (110) [1-10] at a point t/4 (where t is a thickness of the steel sheet) in a thickness direction of the steel sheet is 2.3 or more, and a bake hardenability (BH) of the steel sheet is 4 MPa or more.

10 Claims, 1 Drawing Sheet

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C23C 2/28*** | (2006.01) |
| ***C23C 2/40*** | (2006.01) |

(52) U.S. Cl.
CPC ..... *C21D 8/0226* (2013.01); *C21D 8/0236* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C23C 2/28* (2013.01); *C23C 2/40* (2013.01); *C21D 2211/004* (2013.01)

(58) Field of Classification Search
CPC ..... C21D 2211/004; C22C 38/001; C22C 38/002; C22C 38/02; C22C 38/04; C22C 38/06; C22C 38/12; C22C 38/14; C23C 2/28; C23C 2/40
See application file for complete search history.

(56) References Cited

FOREIGN PATENT DOCUMENTS

| | | | |
|---|---|---|---|
| JP | 61276923 | | 12/1986 |
| JP | 61276931 | | 12/1986 |
| JP | 61276931 | A * | 12/1986 |
| JP | 04280943 | | 10/1992 |
| JP | 05070836 | | 3/1993 |
| JP | 05239554 | | 9/1993 |
| JP | 05263184 | | 10/1993 |
| JP | 06116651 | | 4/1994 |
| JP | 07278770 | | 10/1995 |
| JP | 10096051 | | 4/1998 |
| JP | 2002167645 | | 6/2002 |
| JP | 2004099951 | A * | 4/2004 |
| JP | 2004131754 | | 4/2004 |
| JP | 2012012629 | | 1/2012 |
| JP | 2013064169 | | 4/2013 |
| JP | 2014028998 | | 2/2014 |
| JP | 2015063729 | | 4/2015 |
| KR | 20100096844 | | 9/2010 |
| KR | 20130110651 | | 10/2013 |
| KR | 20150073822 | | 7/2015 |
| KR | 20160071541 | | 6/2016 |

OTHER PUBLICATIONS

JP-61276931-A, Hashiguchi Koichi; Okano Shinobu; Sakata Takashi, English Translation obtained from JPlatPat, 1986 (Year: 1986).*

International Search Report—PCT/KR2017/008435 dated Nov. 24, 2017.

Japanese Office Action—Japanese Application No. 2019-506715 dated Jan. 28, 2020, citing JP 05-239554, JP 2002-167645, JP 2015-063729, JP 61-276923, and JP 61-276931.

European Search Report—European Application No. 17839733.7, dated Apr. 12, 2019, citing JP S61 276931, JP H07 278770, JP H06 116651, KR 101 611 695 and EP 0 572 666.

* cited by examiner

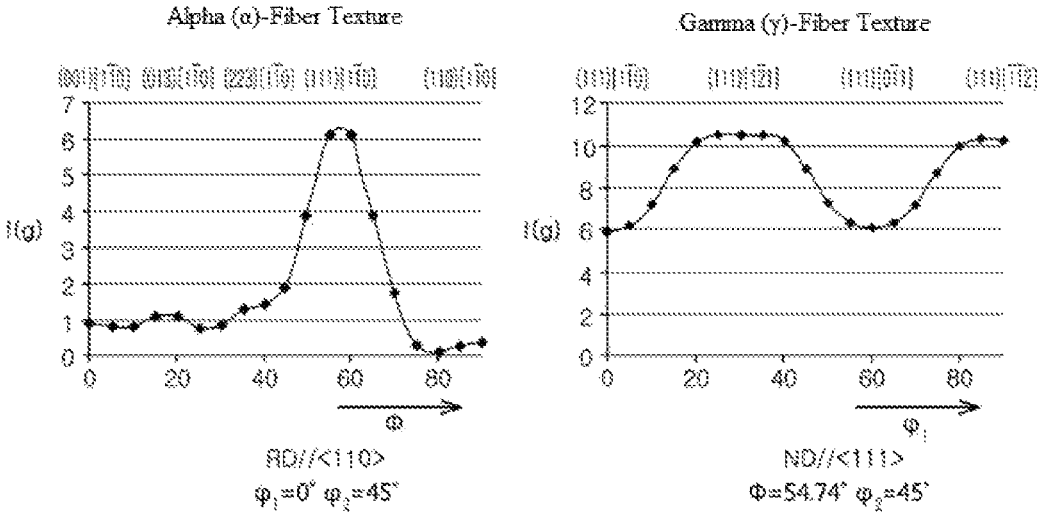
Alpha (α)-Fiber Texture
I(g)
Φ
RD//<110>
φ1=0° φ2=45°
Gamma (γ)-Fiber Texture
I(g)
φ1
ND//<111>
Φ=54.74° φ2=45°

HIGH STRENGTH STEEL SHEET HAVING EXCELLENT FORMABILITY AND MANUFACTURING METHOD THEREOF

TECHNICAL FIELD

The present disclosure relates to a high strength steel sheet and a manufacturing method thereof, and more particularly, to a high strength steel sheet having excellent formability, which may be suitably used as a material for external vehicle panels and the like, and a manufacturing method thereof.

BACKGROUND ART

Steel that may be used as a material for internal or external vehicle panels (doors, hoods, fenders, floors, etc.) may be required to not only have high strength but also excellent formability. This is to ensure the safety of passengers from accidents, and to improve the fuel efficiency by reducing the weight of the vehicle.

However, it is very difficult to satisfy both of the above factors (strength and formability) at the same time, because an increase in the strength of the steel sheet causes deterioration of formability. Particularly, in parts requiring high formability, such as an internal door panel, a rear floor panel, and the like, molding defects, such as cracks, and the like, often may occur during a machining operation, such that the application of high strength steels to these parts may still be very limited.

Known steel sheets having excellent strength and formability, having been developed so far, may include so-called IF steel (Interstitial Free Steel). This may be achieved by adding strong carbonitride forming elements, such as titanium (Ti) and/or niobium (Nb), and removing solid solution elements such as carbon (C), nitrogen (N), and sulfur (S), to secure strength and formability at the same time. Representatives thereof are typically disclosed in Patent Documents 1 to 4. However, the IF steel has an average plastic anisotropy coefficient (Lankford value, r value) of 1.5 to 1.8, which may be insufficient to substitute for the conventional DDC (Deep Drawing Quality) soft cold-rolled steel sheet.

(Patent Document 1) Japanese Patent Publication No. 1992-280943

(Patent Document 2) Japanese Patent Publication No. 1993-070836

(Patent Document 3) Japanese Patent Publication No. 1993-263184

(Patent Document 4) Japanese Patent Publication No. 1998-096051

DISCLOSURE

Technical Problem

An aspect of the present disclosure may provide a high strength steel sheet, having excellent formability, and a manufacturing method thereof.

Technical Solution

According to an aspect of the present disclosure, a high strength steel sheet may include:

by weight, C: 0.001% to 0.004%, Si: 0.5% or less (excluding 0%), Mn: 1.2% or less (excluding 0%), P: 0.005% to 0.12%, S: 0.01% or less, N: 0.01% or less, acid soluble Al: 0.1% or less (excluding 0%), Ti: 0.01% to 0.04%, a remainder of Fe, and unavoidable impurities, wherein the contents of Ti, N, and S satisfy the following Relationship 1, a ratio (b/a) of an average random intensity ratio (b) of an orientation group of (111) [1-10] to (111) [−1-12] to an average random intensity ratio (a) of an orientation group of (001) [1-10] to (110) [1-10] at a point t/4 (where t is a thickness of the steel sheet) in a thickness direction of the steel sheet is 2.3 or more, and a bake hardenability (BH) of the steel sheet is 4 MPa or more.

$$-0.02 \leq [Ti]-(24/7)[N]-(3/2)[S] \leq 0.025 \quad \text{[Relationship 1]}$$

where each of [Ti], [N], and [S] refers to the content (weight %) of the corresponding element.

According to an aspect of the present disclosure, a high strength steel sheet may include:

hot rolling a steel slab comprising, by weight, C: 0.001% to 0.004%, Si: 0.5% or less (excluding 0%), Mn: 1.2% or less (excluding 0%), P: 0.005% to 0.12%, S: 0.01% or less, N: 0.01% or less, acid soluble Al: 0.1% or less (excluding 0%), Ti: 0.01% to 0.04%, a remainder of Fe, and unavoidable impurities, to obtain a hot-rolled steel sheet;

coiling the hot-rolled steel sheet at a temperature within a range of 450° C. to 750° C.;

cold rolling the coiled hot-rolled steel sheet at a reduction ratio of 75% or more to obtain a cold-rolled steel sheet;

heating the cold-rolled steel sheet to an annealing temperature within a range of 830° C. to 880° C., and continuous annealing the heated cold-rolled steel sheet at the annealing temperature for an annealing time of 30 to 80 seconds;

cooling the continuous annealed cold-rolled steel sheet to a temperature within a range of 650° C. or lower at a rate of 2 to 10° C./sec; and temper rolling the cooled cold-rolled steel sheet at a reduction ratio of 0.3% to 1.6%, and wherein an average heating rate from a temperature (recrystallization start temperature+20° C.) to the annealing temperature at a time of heating the cold-rolled steel sheet is 5° C./sec or lower.

Advantageous Effects

According to an aspect of the present disclosure, the steel sheet may have excellent strength and formability, which may be suitably used as a material for external vehicle panels and the like.

DESCRIPTION OF DRAWINGS

FIG. 1 is a graph analyzing the degree of development of a texture of Inventive Example 1.

BEST MODE FOR INVENTION

As a result of deep research to solve the problems of the prior arts described above, the inventors of the present disclosure have found that, when only titanium (Ti), which may be an effective carbonitride forming element in steel, is added, or titanium (Ti) and niobium (Nb) are added in a combination to remove the solid solution elements such as carbon (C), nitrogen (N), sulfur (S), and the like, the position distribution of the carbide, or the like, generated as a result of the removal of the solid solution elements is appropriately controlled, and a texture is controlled, strength and drawability may be remarkably improved; and, when the re-dissolved solid solution carbon remains at an appropriate level during an annealing operation, bake hardenability may be remarkably improved, and the present disclosure has been accomplished.

Hereinafter, a high strength steel sheet having excellent formability, which may be one aspect of the present disclosure, will be described in detail.

First, the alloy components and preferable content ranges of the high strength steel sheet will be described in detail. It is noted in advance that the content of each component described below may be on a weight basis, unless otherwise specified.

C: 0.001% to 0.004%

Carbon may be an interstitial solid solution element, and may have a significant influence on formation of a texture of the steel sheet during cold rolling and annealing operations. In particular, when the amount of solid solution carbon in the steel increases, a growth of crystal grains having a {111} texture, which may be advantageous for drawing workability, may be suppressed, and a growth of crystal grains having {110} and {100} textures may be promoted. Therefore, drawability of the steel sheet may be deteriorated. Further, when the carbon content is an excessively large amount, the Ti content necessary for precipitating the carbide may be excessively disadvantageous from the viewpoint of economical efficiency, and there may be also a problem in which the fine TiC carbides may be distributed in a relatively large amount in the steel to drastically deteriorate drawability. Therefore, in the present disclosure, an upper limit of the content of carbon may be controlled to 0.004%, and preferably 0.0035%. Meanwhile, the lower the carbon content, the better the improvement of drawability. When the content thereof is too low, bake hardenability of the steel sheet may be drastically deteriorated. Therefore, in the present disclosure, a lower limit of the carbon content may be controlled to 0.001%, and preferably 0.0012%.

Si: 0.5% or Less (Excluding 0%)

Silicon may contribute to increase in strength of the steel sheet by solid solution strengthening. When the content thereof is an excessively large amount, surface scale defects may be caused, to deteriorate surface properties of plating. In the present disclosure, an upper limit thereof may be controlled to 0.5%, and preferably 0.05%. In the present disclosure, a lower limit of the silicon content is not particularly limited, but is preferably 0.001%, and more preferably 0.002%.

Mn: 1.2% or Less (Excluding 0%)

Manganese may be a solid solution strengthening element. Manganese may not only contribute to improving strength of the steel, but may also precipitate S in steel as MnS, to inhibit the occurrence of plate breakage and hot embrittlement by S during a hot rolling operation. When the content thereof is an excessively large amount, there may be a problem in which excess Mn is dissolved to deteriorate drawability. In the present disclosure, an upper limit of the manganese content may be controlled to 1.2% or less, preferably 1.0% or less, and more preferably 0.8% or less. In the present disclosure, a lower limit of the manganese content is not particularly limited, but is preferably 0.01%, and more preferably 0.1%.

P: 0.005% to 0.12%

Phosphorus may be effective in solid solution effects, and may be the most effective element to improve strength of the steel without significantly deteriorating drawability. In the present disclosure, a lower limit of the phosphorus content may be controlled to 0.005%, preferably 0.008%, and more preferably 0.010%. When the content thereof is an excessively large amount, excessive P may be precipitated as FeTiP to deteriorate drawability. In the present disclosure, an upper limit of the phosphorus content may be controlled to 0.12%, preferably 0.10%, and more preferably 0.08%.

S: 0.01% or Less, N: 0.01% or Less

Sulfur and nitrogen may inevitably be impurities in the steel. The content thereof may be controlled to be as low as possible, to secure excellent weldability. In the present disclosure, upper limits of the content of sulfur and nitrogen may be controlled to 0.01% or less, respectively, in view of ensuring proper weldability.

Sol.Al: 0.1% or Less (Excluding 0%)

Acid soluble aluminum may precipitate AlN, and may contribute to improve drawability and ductility of the steel sheet. When the content thereof is an excessively large amount, Al-based inclusions may be excessively formed at the time of steelmaking, thereby causing internal defects in the steel sheet. In the present disclosure, an upper limit of the content of the acid soluble aluminum may be controlled to 0.1%, preferably 0.08%, and more preferably 0.05%. In the present disclosure, a lower limit of the content of the acid soluble aluminum is not particularly limited, but is preferably 0.01%, and more preferably 0.02%.

Ti: 0.01% to 0.04%

Titanium may be an element in which the titanium reacts with solid solution carbon and solid solution nitrogen during a hot rolling operation to precipitate Ti-based carbonitrides, thereby contributing greatly to improvement of drawability of the steel sheet. In the present disclosure, a lower limit of the titanium content may be controlled to be 0.01% or more, preferably 0.012% or more, and more preferably, 0.015% or more. When the content thereof is an excessively large amount, Ti, remaining after reacting with solid solution carbon and solid solution nitrogen, may be combined with P to form an excessive amount of FeTiP precipitates, whereby drawability may be deteriorated, and TiC or TiN precipitates may be distributed in a relatively large amount in the steel, and an amount of solid solution carbon may be excessively lowered to deteriorate bake hardenability of the steel sheet. In the present disclosure, an upper limit of the titanium content may be controlled to be 0.04%, and preferably 0.03%.

In addition, a remainder of Fe and inevitable impurities may be included. In a conventional manufacturing process, since impurities, not intended originally, may be inevitably incorporated from raw materials or the surrounding environment, the impurities may not be excluded. These impurities are not specifically mentioned in this specification, as they are known to one of ordinary skill in the related art. In addition, the addition of an effective component other than the above-mentioned composition may be not excluded. In particular, the following components may be further included to further improve mechanical properties of the steel sheet.

Nb: 0.005% to 0.04%

Niobium may function to facilitate formation of a texture during an annealing operation by precipitating solid solution carbon in the form of (Ti, Nb) C complex carbides in a hot rolling operation. Further, when an appropriate amount of Nb is added, plastic anisotropy (0°, 45°, and 90°) in each direction may be improved. Therefore, plastic deformation anisotropy (r-value) in the 0° and 45° directions, relative to the 90° direction, may be increased. As a result, planar anisotropy ($\Delta r$) of a material may reach about zero (0), and an r value may be evenly distributed on a surface of the steel sheet. Therefore, earring-shaped molding defects of the material at the time of a molding operation may be prevented. A lower limit of the niobium content is preferably controlled to 0.005% or more, and more preferably 0.008% or more, to obtain such an effect in the present disclosure. When the content thereof is an excessively large amount, the majority of the solid solution carbon in the steel may be precipitated as fine NbC. Therefore, solid solution carbon may be hardly re-dissolved even after an annealing operation to deteriorate bake hardenability. Further, there may be a problem in which not only drawability (r-value) may be deteriorated due to a relatively small amount of fine (Ti, Nb) C complex carbide to be precipitated, but also the material deterioration may occur due to the increase in a recrystallization temperature. An upper limit of the niobium content is preferably 0.04%, more preferably 0.03%, and even more preferably 0.025%.

B: 0.002% or Less (Excluding 0%)

Boron may inhibit secondary brittleness due to P in the steel. When the content thereof is an excessively large amount, ductility of the steel sheet may be lowered. In the present disclosure, an upper limit of the boron content may be controlled to 0.002% or less, and preferably 0.0015% or less. In the present disclosure, a lower limit of the boron content is not particularly limited, but is preferably 0.0003%, and more preferably 0.0005%.

Meanwhile, when designing an alloy of a steel sheet having the above-described composition range, it is preferable that the contents of Ti, N, and S satisfy the following Relationship 1. When a value of [Ti]−(24/7)[N]−(3/2)[S] is less than −0.02, the Ti content for precipitation of C in steel as TiC may be absolutely insufficient. Therefore, an r value, which is an index for evaluating workability, may be remarkably lowered. Meanwhile, when the value thereof exceeds 0.025, in addition to the TiC precipitates favorable in workability, FeTiP precipitates may be formed to markedly inhibit development of a {111} orientation during an annealing operation. More preferably, the value thereof may be controlled to be −0.01 to 0.01.

$$-0.02 \leq [Ti]-(24/7)[N]-(3/2)[S] \leq 0.025 \quad \text{[Relationship 1]}$$

where each of [Ti], [N], and [S] refers to the content (weight %) of the corresponding element.

Hereinafter, the structure and precipitates of the high strength steel sheet will be described in detail.

An array having a certain plane and orientation generated inside a crystal may refer to a texture. An aspect in which these textures develop into a band in a certain direction may refer to a fiber texture. The texture may be closely related to drawability, and it may be known that the higher the surface strength value of a gamma (γ)-fiber texture in which a {111} plane is formed perpendicular to a rolled plane, drawing workability may be improved. An alpha (α)-fiber texture may be usually defined as RD//<110>, and a gamma (γ)-fiber texture may be defined as ND//<111>.

Meanwhile, in order to form the gamma (γ)-fiber texture as described above, the inventors of the present disclosure have found that, a ratio (b/a) of an average random intensity ratio (b) of the gamma (γ)-fiber texture (an orientation group of (111) [1-10] to (111) [−1-12]) to an average random intensity ratio (a) of the alpha (α)-fiber texture (an orientation group of (001) [1-10] to (110) [1-10]) at a point t/4 (where t is a thickness of the steel sheet) in a thickness direction of the steel sheet from a surface of the steel sheet is very important. More specifically, it may be confirmed that, when a ratio (b/a) of an average random intensity ratio (b) of an orientation group of (111) [1-10] to (111) [−1-12] to an average random intensity ratio (a) of an orientation group of (001) [1-10] to (110) [1-10], at a point t/4 (where t is a thickness of the steel sheet) in a thickness direction of the steel sheet from a surface of the steel sheet is 2.3 or more, an average plastic anisotropy coefficient (Lankford value, r value) of 1.9 or more may be secured to ensure excellent drawability. Meanwhile, the relatively higher the average random intensity ratio of the gamma (γ)-fiber texture (an orientation group of (111) [1-10] to (111) [−1-12]), the better the drawability. Therefore, in the present disclosure, an upper limit thereof is not particularly limited.

Particularly, in the present disclosure, it may be confirmed that, when molding a vehicle part, it is necessary to secure excellent drawability in various directions, not in a specific direction, a complete part without cracking may be formed. Further, it may be confirmed that, when the extent in development of the gamma (γ)-fiber texture at all 0° to 90°, and then values thereof are represented, the complete formability may be expressed. For example, it is advantageous when the development of the average random intensity ratio at all directions, 0° ((111) [1-10]), 30° ((111) [1-21]), 60° ((111) [0-11]), and 90° ((111) [−1-12]) of the gamma (γ)-fiber texture is generally higher.

Meanwhile, average plastic anisotropy coefficient (Lankford value, r value) obtained from plastic anisotropy coefficient measured for each direction with respect to a rolling direction may be a representative material characteristic value indicating drawability, and the value thereof may be calculated from the following Equation 1.

$$r\ \text{value} = (r0 + r90 + 2r45)/4 \quad \text{[Equation 1]}$$

where ri refers to plastic anisotropy coefficient measured in a specimen taken in a direction of i° from a rolling direction.

The larger the r value in the above Equation, the greater the depth of the molding cup in a drawing process. Therefore, drawability may be judged as good. A steel sheet according to one embodiment of the present disclosure may have an r value of 1.9 or more, and may exhibit excellent drawability.

According to one embodiment, an average grain size of the high strength steel sheet may be 5 μm or more, and preferably 7 μm or more. Here, the average grain size refers to an average equivalent circular diameter of crystal grains. In the present disclosure, it is advantageous to obtain crystal grains as coarse as possible, because it is advantageous in view of formability as the grain size is more coarser. For this, by component control, the C content may be reduced to an extremely low carbon steel level of 40 ppm or less, and carbide precipitation may be controlled as effectively as possible to achieve crystal growth during an annealing operation. This may be because the larger the grain size, the easier the carbide precipitation in crystal grains, relative to at grain boundaries. Possibility of occurrence of cracks during a process may be remarkably lowered. Meanwhile, the larger the average grain size, the more advantageous from the viewpoint of formability. In the present disclosure, an upper limit of the average grain size is not particularly limited. There may be a consideration of damaging refractory bricks in an annealing furnace due to high temperature annealing at 860° C. In this consideration, an upper limit thereof may be limited to 20 μm.

According to one embodiment, a high strength steel sheet of the present disclosure may have a $p_{in}$ of 80% or more, and preferably 82% or more, defined by the following Formula 1. When the ratio $P_{in}$ is less than 80%, that is, when a relatively large amount of carbides are precipitated in the grain boundaries, the possibility of cracking during a machining operation may be remarkably high. Therefore, ductility and drawability may be deteriorated. The higher the ratio $P_{in}$ is, it is more advantageous to improve ductility and drawability. Therefore, in the present disclosure, an upper limit of the ratio $P_{in}$ is not particularly limited. Here, the carbide refers to TiC single carbide, NbC single carbide, or (Ti, Nb) C complex carbide.

$$P_{in}(\%)=\{N_{in}/(N_{in}+N_{gb})\}\times 100 \quad \text{[Formula 1]}$$

where $N_{in}$ refers to the number of carbides having an equivalent circular diameter of 20 nm or less present in crystal grains, and $N_{gb}$ refers to the number of carbides having an equivalent circular diameter of 20 nm or less present in grain boundaries.

According to one embodiment, a high strength steel sheet of the present disclosure may include 0.2 or less, and preferably 0.1 or less, FeTiP precipitates per unit area ($\mu m^2$). The FeTiP precipitates may mainly be precipitated in the form of needle, which deteriorates the development of a {111} orientation during an annealing operation. When the FeTiP precipitates are formed at a ratio of more than $0.2/\mu m^2$, drawability may be deteriorated. Meanwhile, the smaller the number of FeTiP precipitates per unit area, the more advantageous it is to improve drawability. Therefore, in the present disclosure, a lower limit of the number of FeTiP precipitates is not particularly limited.

According to one embodiment, a high strength steel sheet of the present disclosure may have a bake hardenability (BH) of 4 MPa or more, more preferably 10 MPa or more, and still more preferably 15 MPa or more, and may exhibit excellent bake hardenability.

According to one embodiment, a high strength steel sheet of the present disclosure may have a thickness of 0.8 mm or less, and may have a product of a yield strength (YS, MPa) and an average plastic anisotropy coefficient (Lankford value, r-value) of 290 MPa or more. Therefore, formability and dent resistance, which refers to resistance to external physical force, may be very excellent, and may preferably be applied to a material for a vehicle external panel.

The high strength steel sheet of the present disclosure described above may be manufactured by various methods, and manufacturing methods thereof are not particularly limited. As a preferable embodiment, the high strength steel sheet may be prepared by the following method.

Hereinafter, a manufacturing method of a high strength steel sheet having excellent formability, which may be another aspect of the present disclosure, will be described in detail.

First, a steel slab having the above-mentioned component system may be hot rolled to obtain a hot-rolled steel sheet.

According to one embodiment, a finish rolling during the hot rolling operation may be carried out in an austenite single phase temperature region (Ar3 (° C.) or higher temperature). When a finish rolling temperature during the hot rolling operation is less than Ar3 (° C.), there may be a high possibility of rolling in a two-phase region. Therefore, material non-uniformity may be caused. For reference, Ar3 (° C.) may be calculated from Formula 2 below.

$$Ar3(^\circ C.)=910-310[C]-80[Mn]-20[Cu]-15[Cr]-55[Ni]-80[Mo] \quad \text{[Formula 2]}$$

where each of [C], [Mn], [Cu], [Cr], [No], and [Mo] refers to the content (weight %) of the corresponding element.

Next, the hot-rolled steel sheet may be coiled.

At this time, a coiling temperature is preferably 450° C. to 750° C., and more preferably 500° C. to 700° C. When the coiling temperature is less than 450° C., a relatively large amount of FeTiP precipitates may be precipitated to deteriorate drawability and to cause warpage of the steel sheet. Meanwhile, when the coiling temperature exceeds 750° C., it may be difficult to re-dissolve solid solution carbon during an annealing operation, as well as to coarsen precipitates, to deteriorate bake hardenability (BH).

According to one embodiment, an average cooling rate from the hot finish rolling temperature to the coiling temperature may be 10 to 200° C./sec. When the average cooling rate is less than 10° C./sec, ferrite crystal grains may grow unevenly, and FeTiP precipitates may be formed. Therefore, it is difficult to secure the desired formability in the present disclosure. Meanwhile, when the cooling rate exceeds 200° C./sec, a temperature of the hot-rolled steel sheet may become uneven, and a shape of the hot-rolled steel sheet may become poor.

Next, the coiled hot-rolled steel sheet may be cold rolled to obtain a cold-rolled steel sheet.

At this time, a cold rolling reduction ratio is preferably 75% or more. When the cold rolling reduction ratio is less than 75%, there may be a problem in which a gamma (γ)-fiber texture does not grow sufficiently and drawability is deteriorated. Meanwhile, an upper limit of the cold rolling reduction ratio is not particularly limited in the present disclosure, because the higher the cold rolling reduction ratio is, it is more advantageous for growth of the gamma (γ)-fiber texture. When the cold rolling reduction ratio is too high, a shape of the steel sheet may be poor due to heavy load of a roll during a rolling operation. Considering this, an upper limit thereof may be limited to 85%.

Next, the cold-rolled steel sheet may be continuously annealed.

At this time, an annealing temperature (T) is preferably 830° C. to 880° C., and more preferably 840° C. to 870° C. When the annealing temperature (T) is less than 830° C., the gamma (γ)-fiber texture which is advantageous in workability may not grow sufficiently, and drawability may be deteriorated. Further, precipitates may not be re-dissolved during an annealing operation to deteriorate bake hardenability. Meanwhile, when the annealing temperature (T) exceeds 880° C., it may be advantageous in workability, but a shape of the steel sheet may become poor due to grain size deviation, and a problem in equipment of an annealing heating furnace may be caused.

Meanwhile, annealing time (t), for example, holding time at the annealing temperature is preferably 30 to 80 sec, and more preferably 40 to 70 sec. When sufficient annealing time is ensured after sufficient development of a gamma (γ)-fiber texture, a portion of carbides may re-dissolved as solid solution carbon. When a cooling operation may be carried out in a state in which such solid solution carbon exists, the solid solution carbon may remain in the steel sheet at an appropriate level during the annealing operation to provide excellent bake hardenability (BH). When the annealing time (t) is less than 30 sec, the solid solution carbon may not remain, or may not be sufficiently in the steel sheet due to lack of re-dissolving time to deteriorate bake hardenability (BH). Meanwhile, when the annealing time (t) exceeds 80 sec, crystal grains may be coarsened, and grain size deviation may be caused to deteriorate a shape of the steel sheet, which may be disadvantageous even in terms of economy.

According to one embodiment, at the time of the continuous annealing operation, the annealing temperature (T, ° C.) and the annealing time (t, sec) may satisfy the following Relationship 2. When the value of 0.001*T*t is less than 30, drawability and bake hardenability may be deteriorated. Meanwhile, when the value of 0.001*T*t exceeds 70, a shape of the steel sheet may poor, due to coarsening of crystal grains and grain size deviation.

$$30 \leq 0.001 * T * t \leq 70 \quad \text{[Relationship 2]}$$

Meanwhile, at the time of continuous annealing, an average heating rate from a recrystallization start temperature +20° C. to the annealing temperature is preferably 5° C./sec or less, more preferably 4.5° C./sec or less, and still more preferably 3.8° C./sec or less. Here, the recrystallization start temperature may be defined as a temperature at which a new recrystallized crystal grain starts to be formed in a process of annealing a rolled structure elongated by a cold rolling operation. More specifically, the recrystallization start temperature may be defined as a temperature at which an area fraction of new recrystallized crystal grain in the entire crystal grains is 50%. In an initial stage of the recrystallization, nucleation and growth of new crystal grains may be accompanied. At this time, the lower the rate of temperature rise, the more the nucleation of a {111} texture, which is advantageous for workability. When the rate of temperature rise in the above-mentioned temperature range exceeds 5° C./sec, nucleation of the {111} texture may be not sufficient at the time of recrystallization, and the crystal grains may be refined to sufficiently secure workability required by the present disclosure. Meanwhile, the slower the rate of temperature rise in the above-mentioned temperature range, the more advantageous nucleation and nuclear growth of the {111} texture may be favorable for the workability. Therefore, a lower limit thereof is not particularly limited in the present disclosure.

Next, the continuous annealed cold-rolled steel sheet may be cooled to a temperature within a range of 650° C. or lower.

At this time, an average cooling rate is preferably 2 to 10° C./sec, and more preferably 3 to 8° C./sec. When the average cooling rate is less than 2° C./sec, the re-dissolved solid solution carbon during the annealing operation may be re-precipitated as carbide to deteriorate bake hardenability. Meanwhile, when the average cooling rate exceeds 10° C./sec, warpage of the steel sheet may be caused. Meanwhile, 650° C. may be a temperature at which most of the precipitation and diffusion of carbide are completed, and cooling conditions thereafter are not particularly limited.

Next, the cooled cold-rolled steel sheet may be temper rolled to obtain a high strength steel sheet.

At this time, a temper reduction ratio is preferably 0.3% to 1.6%. The temper rolling operation may increase yield strength of steel, may increase aging resistance by a large amount of glissile dislocations introduced during a rolling operation, and may increase bake hardenability by solid solution carbon and interaction of dislocations. When the temper reduction ratio is less than 0.3%, it may not only be disadvantageous to the plate shape control, but also the possibility of stretch strain defect due to insufficient glissile dislocations may be relatively high. Meanwhile, when the temper reduction ratio exceeds 1.6%, not only may the possibility of cracks occurring during molding of parts by the client increase, but also there may be a reduction to an r value which is an index for formability.

Next, a hot-dip galvanizing operation may be performed on a surface of the high strength steel sheet to obtain a hot-dip galvanized steel sheet, when necessary. Alternatively, after a hot-dip galvanizing operation, an alloying heat treatment may be performed on a surface of the high strength steel sheet to obtain an alloyed hot-dip galvanized steel sheet. At this time, the alloying heat treatment temperature is preferably 450° C. to 600° C. When the alloying heat treatment temperature is less than 450° C., alloying may be not sufficiently accomplished, and effects originating from sacrificial system may be lowered, or plating adhesion may be lowered. Meanwhile, when the alloying heat treatment temperature exceeds 600° C., alloying may be excessively proceeded with to deteriorate powdering properties. Meanwhile, Fe concentration in a plated layer after the alloying heat treatment is preferably 8 wt % to 12 wt %.

MODE FOR INVENTION

Hereinafter, the present disclosure will be described in more detail by way of examples. However, the following examples are only illustrative of the present disclosure in more detail and do not limit the scope of the present disclosure.

A steel slab (220 mm in thickness) having the alloy composition shown in the following Table 1 was heated to 1,200° C., and hot-rolled to prepare hot-rolled steel sheets (3.2 mm thickness). At this time, a finish rolling temperature was evenly set at about 930° C., which may be a temperature right above Ar3. Thereafter, the hot-rolled steel sheets were coiled, cold rolled, continuous annealed, cooled, and temper rolled under the conditions shown in Table 2 below, to prepare steel sheets.

Then, each of the prepared steel sheets were observed and measured on the number and distribution of precipitates, texture, and the like. The results thereof are shown in Table 3 below. More specifically, ratio of the number of carbides, and the number of FeTiP precipitates were calculated, by observing precipitates in the replica using a TEM, and counting five spots among them as the number of the precipitates per unit length (μm) to calculate an average value thereof. The intensity ratio (using an ODF) of the texture in each directions was calculated and analyzed using an EBSD based on an ND direction decision orientation under the conditions of R (Rolling), T (Transverse), and N (Vertical) at a ¼t point. Meanwhile, FIG. 1 is a graph analyzing the degree of development of a texture of Inventive Example 1, and all Inventive Examples had a tendency similar to Inventive Example 1.

Then, an r value and bake hardenability (BH) were measured for each of the prepared steel sheets. Specimen was taken in accordance with JIS 5 standard, an r value was measured using ASTM STD specimen, and bake hardenability was evaluated as a difference between a yield strength value of a specimen after performing a 2% pre-strain, and a yield strength value after further holding the specimen again at 170° C. for 20 minutes.

TABLE 1

| | Alloy Composition (wt %) | | | | | | | | | | |
|---|---|---|---|---|---|---|---|---|---|---|---|
| Steel | C | Si | Mn | P | S | N | Sol. Al | Ti | Nb | B | *① |
| [1]IS1 | 0.0021 | 0.023 | 0.13 | 0.08 | 0.0040 | 0.0018 | 0.032 | 0.028 | 0.01 | 0.0008 | −0.0094 |
| IS2 | 0.0023 | 0.016 | 0.21 | 0.35 | 0.0058 | 0.0028 | 0.032 | 0.02 | 0.011 | — | 0.0017 |

TABLE 1-continued

| Steel | Alloy Composition (wt %) | | | | | | | | | | |
|---|---|---|---|---|---|---|---|---|---|---|---|
| | C | Si | Mn | P | S | N | Sol. Al | Ti | Nb | B | *① |
| IS3 | 0.0032 | 0.012 | 0.22 | 0.03 | 0.0053 | 0.0029 | 0.032 | 0.021 | — | 0.0006 | 0.0031 |
| IS4 | 0.0019 | 0.016 | 0.62 | 0.032 | 0.0062 | 0.0027 | 0.033 | 0.018 | 0.023 | 0.0009 | −0.0006 |
| IS5 | 0.0017 | 0.013 | 0.61 | 0.02 | 0.0061 | 0.0032 | 0.036 | 0.029 | 0.022 | 0.0009 | 0.0089 |
| IS6 | 0.0008 | 0.008 | 0.9 | 0.03 | 0.0036 | 0.0031 | 0.044 | 0.021 | 0.013 | 0.0006 | 0.0050 |
| IS7 | 0.0015 | 0.01 | 0.31 | 0.05 | 0.0055 | 0.0020 | 0.041 | 0.025 | — | 0.0006 | 0.0099 |
| [2]CS1 | 0.0035 | 0.02 | 0.8 | 0.06 | 0.0045 | 0.0042 | 0.035 | 0.061 | — | — | 0.0399 |
| CS2 | 0.0044 | 0.06 | 0.7 | 0.07 | 0.0038 | 0.0038 | 0.024 | 0.05 | — | — | 0.0313 |

*① refers to [Ti] − (24/7)[N] − (3/2)[S]

[1]IS: Inventive Steel,

[2]CS: Comparative Steel

TABLE 2

| Steel | Coiling | | Cold-Rolling | Annealing | | | Cooling | Temper Rolling | |
|---|---|---|---|---|---|---|---|---|---|
| | Temp. (° C.) | Average Cooling Rate (° C./s) | Reduction Ratio (%) | Heating Rate (° C./sec) | Temp. (° C.) | Time (s) | Cooling Rate (° C./sec) | Reduction Ratio (%) | Etc. |
| [1]IS1 | 680 | 45 | 78.5 | 3.2 | 848 | 42 | 3.3 | 0.6 | [3]IE1 |
| | **440** | 52 | 79.2 | **6.2** | 850 | 45 | 4.6 | 0.6 | [4]CE1 |
| IS2 | 630 | 65 | **73.5** | 4.3 | **820** | **23** | 6.4 | 0.8 | CE2 |
| | 630 | 59 | 79.8 | 3.1 | 861 | 78 | 4.5 | 0.8 | IE2 |
| IS3 | 620 | 85 | **73.3** | 3.3 | **795** | 65 | 3.8 | **1.7** | CE3 |
| | 680 | 125 | 79.6 | 2.8 | 849 | 56 | 3.6 | 0.5 | IE3 |
| | 700 | 123 | 80.0 | 2.8 | 862 | 58 | 5.0 | 0.8 | IE4 |
| | **765** | **8** | 80.1 | **5.2** | 845 | **25** | **1.5** | 0.9 | CE4 |
| IS5 | 630 | 79 | 80.4 | 1.8 | 852 | 58 | 4.5 | 1.2 | IE5 |
| | 720 | **220** | 80.3 | **5.3** | **810** | 52 | 3.6 | 0.8 | CE5 |
| IS6 | 630 | 162 | 80.3 | **6.3** | 851 | 62 | 1.7 | 0.7 | CE6 |
| | 620 | 140 | 80.2 | 3.6 | 843 | 55 | 5.0 | 0.6 | IE6 |
| IS7 | 600 | 98 | 78.5 | 4.2 | 845 | **86** | **12.2** | **0.2** | IE7 |
| | 640 | 102 | 79.3 | 2.8 | 845 | 51 | 3.0 | 0.9 | IE7 |
| [2]CSI | 630 | 78 | 76.3 | 3.5 | 832 | 55 | 5.0 | 0.8 | CE8 |
| | 720 | 75 | 77.8 | 3.5 | 835 | 56 | 5.0 | 0.8 | CE9 |
| CS2 | 560 | 79 | 78.2 | 4.5 | 842 | 58 | 5.0 | 0.8 | CE10 |
| | 560 | 82 | 78.3 | 4.5 | 832 | 57 | 5.0 | 0.8 | CE11 |

[1]IS: Inventive Steel,
[2]CS: Comparative Steel,
[3]IE: InventiveExample,
[4]CE: Comparative Example

TABLE 3

| Steel | P(%) | FeTiP Precipitates Number (/μm$^2$) | Random Strength Ratio (b/a)* | YS X r Value | BH(MPa) | R Value | Etc. |
|---|---|---|---|---|---|---|---|
| [1]IS1 | 85.5 | 0.16 | 3.5 | 382 | 6.5 | 1.95 | [3]IE1 |
| | **75.3** | **0.31** | **1.6** | 356 | 4.5 | **1.68** | [4]CE1 |
| IS2 | 91.2 | 0.02 | **1.3** | 315 | **0.3** | **1.65** | CE2 |
| | 91.3 | 0.02 | 4.2 | 345 | 11.5 | 2.06 | IE2 |
| IS3 | 86.2 | 0.03 | **1.7** | **286** | **0** | **1.71** | CE3 |
| | 88.5 | 0.05 | 2.8 | 315 | 8.5 | 2.05 | IE3 |
| IS4 | 86.3 | 0.05 | 3.5 | 336 | 15.7 | 2.23 | IE4 |
| | 83.2 | 0.02 | 2.7 | 318 | **2.5** | **1.81** | CE4 |
| IS5 | 89.2 | 0.06 | 3.1 | 326 | 5.2 | 2.23 | IE5 |
| | 82.5 | 0.05 | **1.6** | 318 | **1.6** | **1.72** | CE5 |
| IS6 | 81.3 | 0.08 | 3.3 | **284** | **3.1** | 1.92 | CE6 |
| | 82.6 | 0.07 | 8.5 | 315 | 15.2 | 2.16 | IE6 |
| IS7 | 85.4 | 0.18 | 6.3 | 312 | **3.2** | 2.05 | CE7 |
| | 83.2 | 0.16 | 7.1 | 328 | 13.5 | 2.22 | IE7 |
| [2]CS1 | 63.6 | 8.3 | 3.6 | 325 | 0 | 1.78 | CE8 |
| | 68.2 | 7.8 | 3.2 | 326 | 0 | 1.81 | CE9 |

TABLE 3-continued

| Steel | P(%) | FeTiP Precipitates Number (/μm²) | Random Strength Ratio (b/a)* | YS X r Value | BH(MPa) | R Value | Etc. |
|---|---|---|---|---|---|---|---|
| CS2 | 73.5 | 11.5 | 3.6 | 316 | 0 | 1.85 | CE10 |
| | 71.5 | 1.7 | **1.3** | 312 | 0 | 1.79 | CE11 |

*The random intensity ratio (b/a) refers to a ratio (b/a) of an average random intensity ratio (b) of an orientation group of (111)[1-10] to (111)[−1-12] to an average random intensity ratio (a) of an orientation group of (001)[1-10] to (110)[1-10] at a point t/4 (where t is a thickness of the steel sheet) in a thickness direction of the steel sheet.

[1]IS: Inventive Steel,

[2]CS: Comparative Steel,

[3]IE: Inventive Example,

[4]CE: Comparative Example

Referring to Table 3, it can be seen that, in the case of Inventive Examples 1 to 7, which the alloy composition and the manufacturing conditions satisfy the ranges suggested by the present disclosure, all the number of FeTiP precipitates per unit area, the ratio of the carbides having a size of 20 nm or less present in the ferrite crystal grains, and random intensity ratio (b/a) fall within the ranges to be controlled by the present disclosure, and, in addition and basically, an r-value may be secured to be 1.9 or more, a product of yield strength*r value may be secured to be 290 MPa or more, and BH may be secured to be 4 MPa or more.

In the meantime, in the case of Comparative Examples 1 to 7, the alloy composition satisfies the range proposed in the present disclosure, but at least one of the manufacturing conditions does not satisfy the ranges proposed in the present disclosure. Therefore, the results showed that drawability and bake hardenability thereof were poor. In addition, in the case of Comparative Examples 8 to 11, the alloy composition did not satisfy the ranges proposed in the present disclosure. Therefore, the results showed that drawability and bake hardenability thereof were poor.

While exemplary embodiments have been shown and described above, it will be apparent to those skilled in the art that modifications and variations could be made without departing from the scope of the present disclosure as defined by the appended claims.

The invention claimed is:

1. A high strength steel sheet comprising, by weight, C: 0.001% to 0.004%, Si: 0.5% or less excluding 0%, Mn: 1.2% or less excluding 0%, P: 0.005% to 0.12%, S: 0.01% or less, N: 0.01% or less, acid soluble Al: 0.1% or less excluding 0%, Ti: 0.01% to 0.04%, a remainder of Fe, and unavoidable impurities, wherein the contents of Ti, N, and S satisfy the following Relationship 1, $$-0.02 \leq [Ti]-(24/7)[N]-(3/2)[S] \leq 0.025 \quad \text{[Relationship 1]}$$

where each of [Ti], [N], and [S] refers to the content (weight %) of the corresponding element, a ratio (b/a) of an average random intensity ratio (b) of an orientation group of (111) [1-10] to (111) [−1-12] to an average random intensity ratio (a) of an orientation group of (001) [1-10] to (110) [1-10] at a point t/4 (where t is a thickness of the steel sheet) in a thickness direction of the steel sheet is 2.3 or more, and a bake hardenability (BH) of the steel sheet is 4 MPa or more, and wherein a $p_{in}$ as defined by the following Formula 1 is 80% or more, $P_{in}(\%)=\{N_{in}/(N_{in}+N_{gb})\}\times 100$ where $N_{in}$ refers to a number of carbides having an equivalent circular diameter of 20 nm or less present in crystal grains, and $N_{gb}$ refers to a number of carbides having an equivalent circular diameter of 20 nm or less present in grain boundaries.

2. The high strength steel sheet according to claim 1, further comprising one or more selected from the group consisting of, by weight, Nb: 0.005% to 0.04%, and B: 0.002% or less excluding 0%.

3. The high strength steel sheet according to claim 1, further comprising FeTiP precipitates of 0.2/μm² or less.

4. The high strength steel sheet according to claim 1, wherein a product of yield strength (YS) and average plastic anisotropy coefficient (Lankford value, r-value) is 290 MPa or more.

5. A manufacturing method of the high strength steel sheet according to claim 1, comprising:

hot rolling a steel slab comprising, by weight, C: 0.001% to 0.004%, Si: 0.5% or less excluding 0%, Mn: 1.2% or less excluding 0%, P: 0.005% to 0.12%, S: 0.01% or less, N: 0.01% or less, acid soluble Al: 0.1% or less excluding 0%, Ti: 0.01% to 0.03%, a remainder of Fe, and unavoidable impurities, to obtain a hot-rolled steel sheet;

coiling the hot-rolled steel sheet at a temperature within a range of 450° C. to 750° C.;

cold rolling the coiled hot-rolled steel sheet at a reduction ratio of 75% or more to obtain a cold-rolled steel sheet;

heating the cold-rolled steel sheet to an annealing temperature within a range of 830° C. to 880° C., and continuous annealing the heated cold-rolled steel sheet at the annealing temperature for an annealing time of 30 to 80 seconds;

cooling the continuous annealed cold-rolled steel sheet to a temperature within a range of 650° C. or lower at a rate of 2 to 10° C./sec; and temper rolling the cooled cold-rolled steel sheet at a reduction ratio of 0.3% to 1.6%, and wherein an average heating rate from a temperature (recrystallization start temperature+20° C.) to the annealing temperature at a time of heating the cold-rolled steel sheet is 5° C./sec or lower, wherein the annealing temperature (T, ° C.) and the annealing time (t, sec) during the continuous annealing operation satisfy the following Relationship 2, $$30 \leq 0.001 * T * t \leq 70, \text{ and} \quad \text{Relationship 2}$$

wherein the annealing time (t, sec) represents holding time at the annealing temperature at continuous annealing.

6. The manufacturing method according to claim 5, further comprising one or more selected from the group consisting of, by weight, Nb: 0.005% to 0.04%, and B: 0.002% or less excluding 0%.

7. The manufacturing method according to claim 5, wherein a finish rolling temperature during the hot rolling operation is Ar3 (° C.) or higher.

8. The manufacturing method according to claim 7, wherein an average cooling rate from the finish rolling temperature to the coiling temperature is 10 to 200° C./sec.

9. The manufacturing method according to claim 5, further comprising hot-dip galvanizing a surface of the temper rolled cold-rolled steel sheet.

10. The manufacturing method according to claim 9, further comprising performing an alloy heat treatment at a temperature within a range of 450° C. to 600° C. after the hot-dip galvanizing operation.

* * * * *